US005823755A

United States Patent [19]

Wilson et al.

[11] Patent Number: 5,823,755

[45] Date of Patent: Oct. 20, 1998

[54] ROTARY COMPRESSOR WITH DISCHARGE CHAMBER PRESSURE RELIEF GROOVE

[75] Inventors: Francis P. Wilson, Liverpool; Andrea B. Dacosta, Syracuse; James W. Bush, Skaneateles, all of N.Y.

[73] Assignee: Carrier Corporation, Syracuse, N.Y.

[21] Appl. No.: 762,372

[22] Filed: Dec. 9, 1996

[51] Int. Cl.[6] ..... F04C 18/356

[52] U.S. Cl. ..... 418/15; 418/63; 418/183

[58] Field of Search ..... 418/15, 63–67, 418/183

[56] References Cited

U.S. PATENT DOCUMENTS 292,898 2/1884 D'Andree ..... 418/183

3,081,707 3/1963 Marshall ..... 418/67

FOREIGN PATENT DOCUMENTS 1-193095 8/1989 Japan .

*Primary Examiner*—John J. Vrablik

[57] ABSTRACT

The annular piston of a rolling piston compressor coacts with a groove in valving action such that the groove serves as a supplemental discharge flow area but gas therein is prevented from constituting part of the suction flow. The groove may be in the motor end bearing and/or pump end bearing and permits flow from the compression chamber to the interior of the piston which is in fluid communication with the interior of the shell while the compression chamber is undergoing discharge.

15 Claims, 4 Drawing Sheets

ROTARY COMPRESSOR WITH DISCHARGE CHAMBER PRESSURE RELIEF GROOVE

BACKGROUND OF THE INVENTION

In positive displacement compressors it is desirable to have a large discharge port area for flow efficiency. Associated with an increase in the area of the discharge port is an increase in the clearance volume. The clearance volume is the amount of compressed gas upstream of the discharge valve at the end of the compression/discharge stroke. This compressed gas which has had work done on it flows into the suction chamber during the suction stroke and represents loss of both work and capacity.

SUMMARY OF THE INVENTION

In a high side hermetic rolling piston compressor, the normal communication path between suction and discharge via the discharge port controlled by the discharge valve is supplemented by a fluid path across the rolling piston. The interior of the rolling piston is in communication with the interior of the shell via one or more fluid paths. The rolling piston coacts with the fluid path across the rolling piston in a valving action. The discharge process begins at a crank angle of about 210° so that at about that point the rolling piston permits communication across the rolling piston by uncovering both ends of a groove in the motor end bearing and/or the pump end bearing. With both ends of the groove uncovered the groove constitutes a supplemental discharge and provides an increased discharge area. Unlike the conventional discharge enlargement where the clearance volume increases and exhausts back to suction, the valving action of the rolling piston seals off the discharge gas in the groove and does not communicate it to the trapped volume being compressed until suction is complete or at least until it will not reduce the mass being compressed due to the time lag in communicating the effects of feed back with the suction port.

It is an object of this invention to increase the net flow area through which the vapor in the discharge chamber must travel at the end of the compression process.

It is an object of this invention to limit clearance volume losses while increasing discharge flow area. These objects, and others as will become apparent hereinafter, are accomplished by the present invention.

Basically, the rolling piston coacts with a groove in a valving action such that the groove serves as a supplemental discharge flow area but gas therein is prevented from constituting part of the suction flow.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
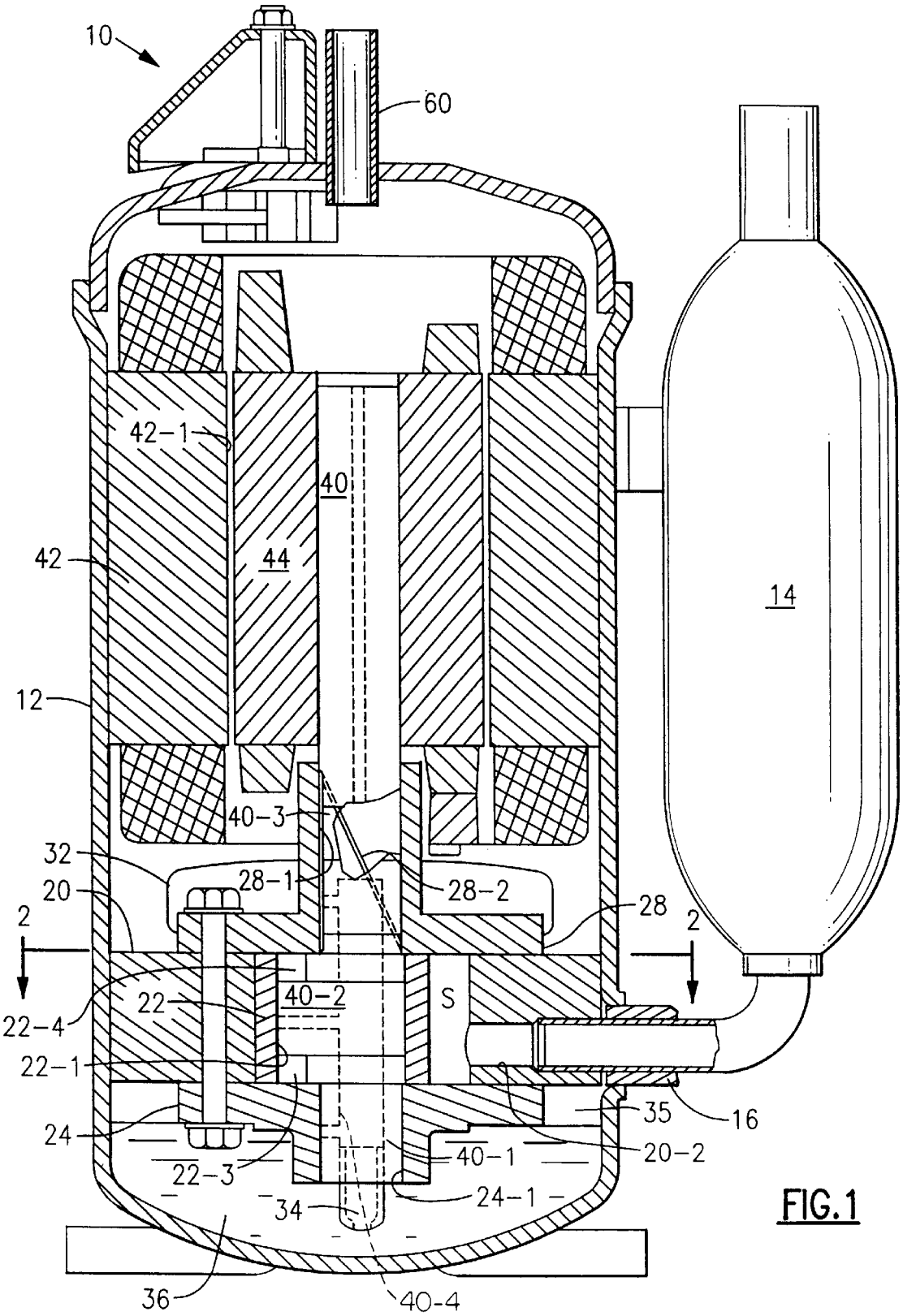
FIG. 1 is a vertical sectional view of a rolling piston compressor taken through the suction structure.
Figure 2:
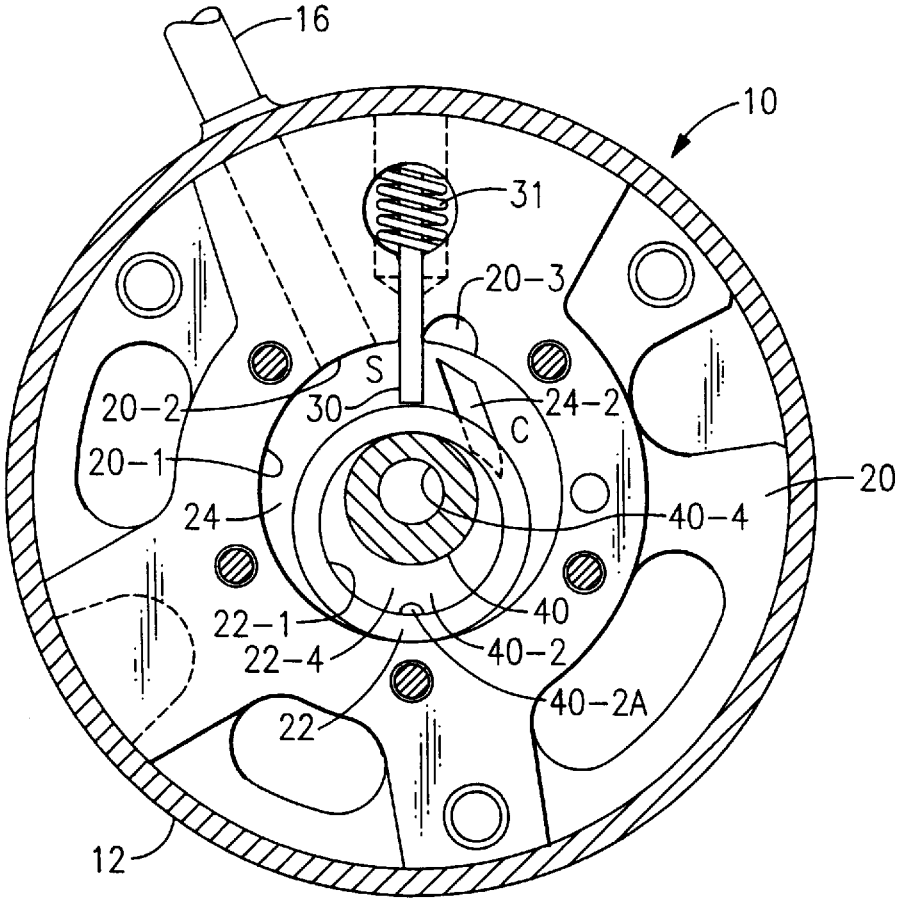
FIG. 2 is a sectional view taken along line 2—2 in FIG. 1.
Figure 3:
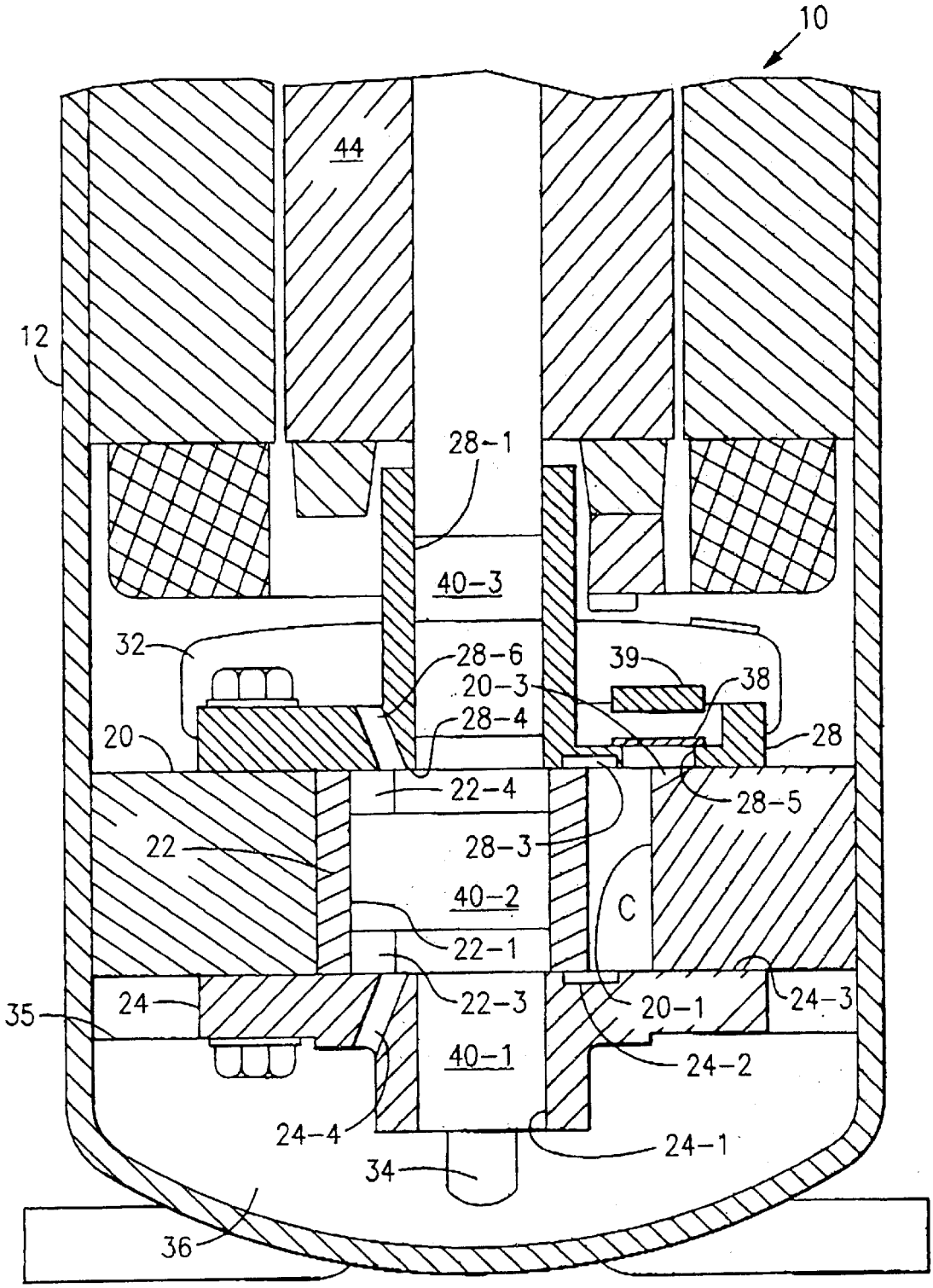
FIG. 3 is a partial vertical sectional view corresponding to that of FIG. 1 but taken through the discharge structure which is the subject matter of this invention.
Figure 5:
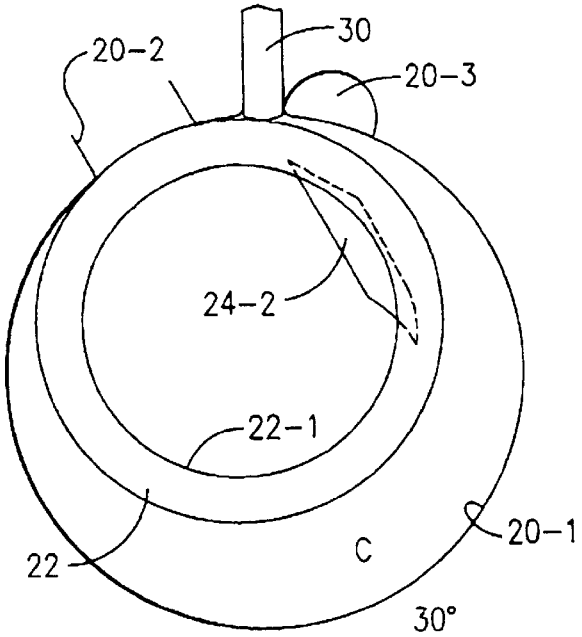
FIGS. 5–8 correspond to FIG. 2 with the rolling piston repositioned to crank angles of, nominally, 30°, 50°, 210° and 280°, respectively.
Figure 6:
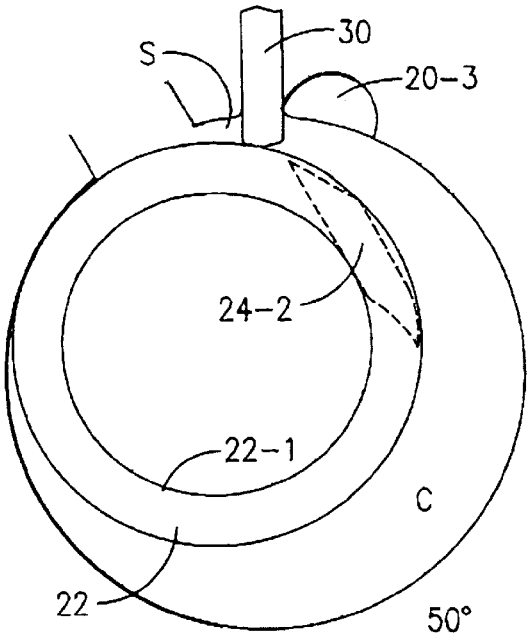
Figure 7:
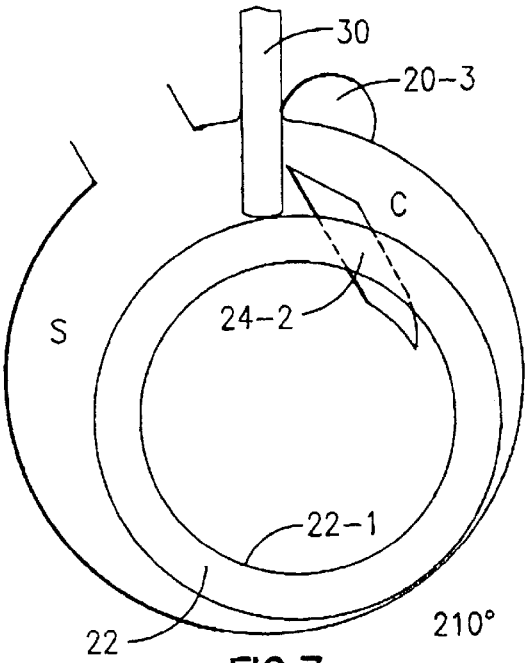
Figure 8:
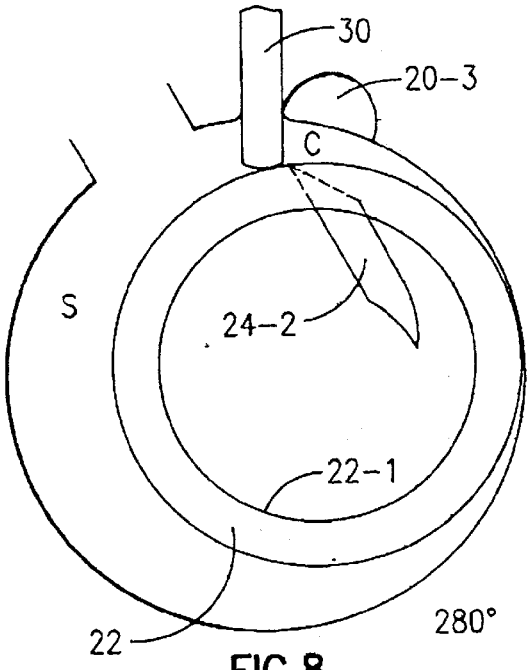

In FIGS. 1 to 3, the numeral 10 generally designates a vertical, high side rolling piston compressor. The numeral 12 generally designates the hermetic shell or casing. Suction tube 16 is sealed to shell 12 and provides fluid communication between suction accumulator 14, which is connected to the evaporator (not illustrated), and suction chamber S. Suction chamber S is defined by bore 20-1 in cylinder 20, annular piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil distribution groove 28-2 is formed in bore 28-1. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define an electric motor. Vane 30 is biased into contact with piston 22 by spring 31.

Figure 4:
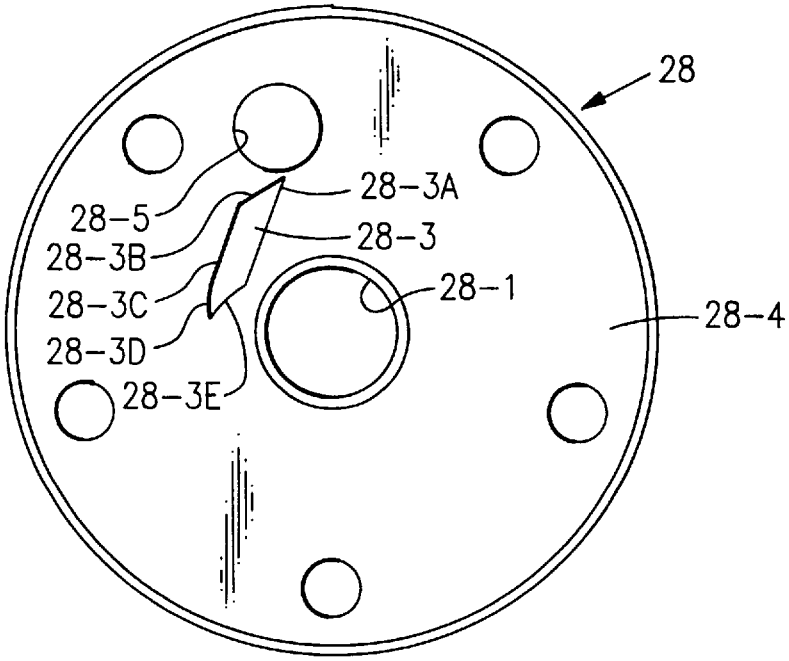
FIG. 4 is a pump end view of the motor bearing employing the present invention.

Referring to FIG. 3, discharge port 28-5 is formed in motor end bearing 28 and partially overlies bore 20-1 and overlies discharge recess 20-3 which is best shown in FIG. 2 and which provides a flow path from compression chamber C to discharge port 28-5. Discharge port 28-5 is serially overlain by discharge valve 38 and spaced valve stop 39, as is conventional. As described so far, compressor 10 is generally conventional. The present invention adds a groove in the pump end bearing 24 and/or the motor end bearing 28 and fluid paths between the interior of piston 22 defined by bore 22-1 and the interior of shell or casing 12 which is at discharge pressure. Specifically a groove 24-2 is formed in surface 24-3 of pump end bearing 24 and/or a groove 28-3 is formed in surface 28-4 of motor end bearing 28. Grooves 24-2 and 28-3 are on the order of 1 mm to 5 mm in depth. As is best shown in FIG. 4, groove 28-3 has the shape of a distorted parallelogram having a width less than the radial thickness of the wall of annular piston 22. Sides 28-3A and 28-3C are parallel with side 28-3B connecting sides 28-3A and 28-3C. Side 28-3D is curved to correspond to the outer curve of the wall of annular piston 22 to prevent the premature uncovering of groove 28-3 by piston 22 and thereby to permit communication prior to the end of the suction cycle. Side 28-3E is curved to correspond to the inner curve of the wall of annular piston 22 to prevent communication across piston 22 prior to the beginning of discharge.

As part of the normal lubrication structure, groove 28-2 extends the full axial length of bore 28-1 and groove 40-2A extends the axial length of eccentric 40-2. Accordingly, there is normally some degree of fluid communication between the chambers 22-3 and 22-4 which are formed by piston 22 and eccentric 40-2 coacting with bearings 24 and 28, respectively and with the interior of shell 12 via groove 28-2. The grooves 28-2 and 40-2A are fed oil via radial passages (shown in phantom) extending from bore 40-4 and may be adequate for the supplemental discharge while providing adequate lubrication unmodified, or by enlarging groove 28-2 and/or 40-2A. Preferably, however, it is desirable to provide bore or passage 24-4 in pump end bearing 24 if groove 24-2 is present so as to connect chamber 22-3 with chamber 35 located over sump 36. Similarly, it is desirable to provide bore or passage 28-6 in motor end bearing 28 if groove 28-3 is present so as to connect chamber 22-4 with the interior of muffler 32.

The shape of grooves 24-2 and 28-3 is chosen to provide a large flow path area, to prevent communication between the groove(s) and suction, and to permit communication between the compression chamber and the interior of shell 12 at the start of discharge. The distorted parallelogram described above meets these goals. The following discussion considers the point where contact between the piston 22 and bore 20-1 passes the suction port 20-2 to be the earliest time to permit communication between the groove 24-2 and/or groove 28-3 with the compression chamber C. The point can, however, be located earlier in the cycle due to the time lag between communication via groove 24-2 and/or groove 28-3 with the suction chamber S and its effects occurring at the suction inlet. Factors such as the operating speed would have to be considered in advancing the communication via groove 24-2 and/or groove 28-3.

Turning now to FIGS. 2 and 5–8, various coactions between piston 22 and groove 24-2 are illustrated although the same coaction would take place between piston 22 and groove 28-3. Assuming the 12 o'clock position to be 0° and measuring counterclockwise, the end of the suction stroke ends at crank angle of approximately 50° and the suction chamber, S, becomes the compression chamber, C. The exact location of the end of the suction stroke is influenced by the separation between vane 30 and suction passageway 20-2 and by the circumferential extent of passageway 20-2 relative to bore 20-1. The progression of the compression process is serially shown in FIGS. 5, 6, 2, 7 and 8. Starting with FIG. 5, groove 24-2 only communicates with the interior of piston 22 and thereby into the interior of shell 12. The suction process has ended and compression chamber C is at its largest volume. Sequencing to the FIG. 6 position, groove 24-2 is entirely isolated by annular piston 22 which overlies groove 24-2. Compression chamber C is reduced in volume and a suction chamber S is starting to form. Sequencing to the FIG. 2 position, the groove 24-2 solely communicates with compression chamber C such that any pressurized refrigerant contained in groove 24-2 by the coaction with piston 22 has been delivered to compression chamber C after it was isolated from suction. Suction chamber S has formed and compression chamber C has continued to reduce in volume. Sequencing to the FIG. 7 position, piston 22 has been positioned relative to groove 24-2 such that one end is uncovered in compression chamber C and the opposite end is uncovered within bore 22-1 such that a fluid path exists across piston 22 via groove 24-2. The discharge process has started with some of the flow being discharged from chamber C via discharge port 28-5 and a portion via groove 24-2 and one or more of passages 22-3, 40-2A, 28-6 and 28-2. Compression chamber C continues to reduce and suction chamber S continues to increase. Sequencing to the FIG. 8 position, piston 22 overlies and coacts with groove 24-2 such that it does not communicate with compression chamber C, but it does communicate with the interior of piston bore 22-1. Chamber C continues to decrease as chamber S increases and the discharge and suction strokes near completion.

From the foregoing description, it should be clear that groove 24-2 (1) does not communicate with the suction chamber, (2) only communicates with the compression chamber when it is isolated from suction so that the volume corresponding to a clearance volume associated with groove 24-2 is always delivered to the trapped volume to increase the mass being compressed and (3) only communicates across piston 22 during the discharge stroke and thereby acts as a supplemental discharge port. The corresponding operation would also be true for groove 28-3.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. Oil delivered to bore 40-4 is able to flow into a series of radially extending passages, in portion 40-1, eccentric 40-2 and portion 40-3 to lubricate bearing 24, piston 22, and bearing 28, respectively. Piston 22 coacts with vane 30 in a conventional manner such that gas is drawn through suction tube 16 and passageway 20-2 to suction chamber S. The gas in suction chamber S is trapped, compressed and discharged from compression chamber C via a flow path defined, in part, by recess 20-3 into discharge port 28-5. The high pressure gas unseats the valve 38 and passes into the interior of muffler 32. The compressed gas passes through muffler 32 into the interior of shell 12 and passes via the annular gap between rotating rotor 44 and stator 42 and through discharge line 60 to the condenser of a refrigeration circuit (not illustrated). At the completion of the compression process, piston 22 will be tangent to the bore 20-1, in the region of recess 20-3. The conventional clearance volume will be the volume of recess 20-3 and the volume of discharge port 28-5 and the volume of the material removed to form recess 28-3.

Superimposed upon the conventional operation described above, is the operation due to the presence of groove 24-2 and/or groove 28-3. Specifically, groove 24-2 and/or groove 28-3 is uncovered at a crank angle of, nominally, 50° which is after the time when suction chamber S is sealed and becomes the compression chamber C during the next compression process. Although the groove 24-2 and/or groove 28-3 is uncovered, it does not yet communicate the discharge chamber volume with the volume located at the inside of bore 22-1. The trapped volume in groove 24-2 and/or groove 28-3 is at discharge line pressure and temperature and expands in the compression chamber C which is then at a much lower pressure and temperature. Because the suction process has already occurred, this re-expanding vapor does not change the amount of suction chamber vapor that has already filled the suction chamber S. Hence, there is no decrease in the mass flow through compressor 10. It does, however, raise the temperature and pressure in the compression chamber C at the beginning of the compression process. This increase in pressure and temperature does increase the total compression power required. At a crank angle of approximately 210°, the angle at which the discharge process begins, the groove 24-2 and/or groove 28-3 connects the discharge chamber volume and the volume inside piston 22, specifically chambers 22-3 and 22-4, respectively, and this increases the discharge flow area. The increase in discharge flow area reduces the discharge flow velocity and the associated flow losses, which reduces the discharge process power. The reduction in discharge process power is greater than the earlier increase in compression power and the total compression power consumption is thereby reduced. The groove 24-2 and/or groove 28-3 allows the venting of the discharge vapor at discharge pressure to chambers 22-3 and 22-4, respectively, in bore 22-1 and eventually to the interior of shell 12 at discharge line pressure. In essence groove 24-2 and/or groove 28-3 is an extension of the discharge port 28-5 in motor end bearing 28.

Although preferred embodiments of the present invention have been illustrated and described, other changes will occur to those skilled in the art. For example, the present invention can be used to reduce the conventional discharge port size and therefore its clearance volume losses, particularly when both groove 24-2 and groove 28-3 are employed. It is therefore intended that the present invention is to be limited only by the scope of the appended claims.

What is claimed is:

1. In a high side rotary compressor having an interior at discharge pressure, an annular piston located in and movable in a chamber defined by a cylinder bore with bearing means located at each end of the bore and a vane coacting with said annular piston to define suction and discharge chambers, a primary discharge extending between said discharge chamber and said interior, supplemental discharge means extending between said discharge chamber and said interior and including:

a groove located in one of said bearing means and forming a portion of said supplemental discharge means;

said annular piston having a bore forming a portion of said supplemental discharge means and coacting with said groove as said piston moves in said chamber whereby said piston and groove coact in the nature of a valving action to permit flow through said supplemental discharge means only when said compression chamber is undergoing discharge.

2. The supplemental discharge means of claim 1 wherein a groove is located in a second of said bearing means.

3. The supplemental discharge means of claim 1 wherein said groove is on the order of 1 mm to 5 mm in depth.

4. The supplemental discharge means of claim 1 wherein said groove has a periphery having one portion corresponding in curvature to an inside wall of said annular piston and a second portion corresponding in curvature to an outside wall of said annular piston whereby said valving action is optimized.

5. The supplemental discharge means of claim 1 wherein both of said bearing means, said piston, said cylinder bore and said vane coact to define a suction chamber and said valving action prevents said groove from establishing fluid communication with said suction chamber.

6. The supplemental discharge means of claim 1 wherein said valving action permits compressed gas sealed off in said groove to be supplied to said compression chamber at a point early in the compression cycle and prior to discharge.

7. A high side rotary compressor means comprising:

shell means having a first end and a second end;

cylinder means containing pump means including a vane and an annular piston coacting with said cylinder means to define suction and compression chambers;

said cylinder means being fixedly located in said shell means near said first end;

first bearing means secured to said cylinder means and extending towards said first end;

second bearing means secured to said cylinder means and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston for moving said piston in said cylinder means;

said rotor means secured to said shaft means so as to be integral therewith and located within said stator means so as to define therewith an annular gap;

suction means for supplying gas to said pump means;

discharge means fluidly connected to said shell means;

muffler means;

a discharge flow path extending between said compression chamber and said discharge means and including a discharge port means overlain by valve means and discharging into said muffler means and thence into the interior of said shell means;

a supplemental discharge flow path between said compression chamber and said discharge means;

groove means formed in at least one of said bearing means in a surface which forms an interior surface of said compression chamber and which constitutes a portion of said supplemental discharge flow path;

said supplemental discharge flow path further including a chamber defined in part by a bore in said annular piston means;

said groove means coacting with said annular piston as said piston is moved to provide a valving action to control flow from said compression chamber into said supplemental discharge flow path;

said groove means overlying a portion of said compression chamber and said bore only during discharge from said compression chamber.

8. The compressor means of claim 7 wherein said groove means is located in said first bearing means.

9. The compressor means of claim 8 further including groove means in said second bearing means.

10. The compressor means of claim 7 wherein said groove means is located in said second bearing means.

11. The compressor means of claim 7 wherein said groove means is on the order of 1 mm to 5 mm in depth.

12. The compressor means of claim 7 wherein said groove means has a periphery having one portion corresponding in curvature to an inside wall of said annular piston and a second portion corresponding in curvature to an outside wall of said annular piston whereby said valving action is optimized.

13. The compressor means of claim 7 wherein said valving action prevents said groove means from establishing fluid communication with said suction chamber.

14. The compressor means of claim 7 wherein said valving action permits compressed gas sealed off in said groove means to be supplied to said compression chamber at a point early in the compression cycle and prior to discharge.

15. The compressor means of claim 7 wherein said bore is in communication with said discharge means via a passage in one of said first and second bearing means.

* * * * *

UNITED STATES PATENT AND TRADEMARK OFFICE

CERTIFICATE OF CORRRECTION

PATENT NO. :5,823,755
DATED :October 20, 1998
INVENTOR(S) :Francis P. Wilson, et. al.

It is certified that error appears in the above-identified patent and that said Letters Patent is hereby corrected as shown below:

Title page, item [56], insert the following:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | EP | 0 | 18 | 42 | 81 | A | 1 | 06/11/1986 | EPO | | | | |
| | | GB | 4 | 0 | 6 | 7 | 2 | 0 | 02/27/1934 | EPO | | | | |
| | | | | | | | | | | | | | | |

Signed and Sealed this

Sixth Day of April, 1999

*Attest:*

*Attesting Officer*

Q. TODD DICKINSON

*Acting Commissioner of Patents and Trademarks*